US006585115B1

(12) United States Patent
Reddoch et al.

(10) Patent No.: US 6,585,115 B1
(45) Date of Patent: Jul. 1, 2003

(54) APPARATUS AND METHOD FOR TRANSFERRING DRY OIL AND GAS WELL DRILL CUTTINGS

(75) Inventors: Jeffrey Reddoch, Lafayette, LA (US); Glynn M. Hollier, Aberdeenshire (GB)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/724,580

(22) Filed: Nov. 28, 2000

(51) Int. Cl.[7] ..... B03B 9/02

(52) U.S. Cl. ..... 209/3; 209/17; 209/73; 209/281; 175/66; 175/206; 175/207

(58) Field of Search ..... 207/3, 17, 73, 207/281; 175/206, 207, 213

(56) References Cited

U.S. PATENT DOCUMENTS 5,090,498 A 2/1992 Hamill ..... 175/206
6,009,959 A * 1/2000 Dietzen ..... 175/66
6,170,580 B1 * 1/2001 Reddoch ..... 175/66

FOREIGN PATENT DOCUMENTS

GB 2 339 443 A 1/2000 ..... E21B/21/06

* cited by examiner

*Primary Examiner*—Donald P. Walsh
*Assistant Examiner*—Jonathan R Miller
(74) *Attorney, Agent, or Firm*—Madan, Mossman & Sriram, P.C.

(57) ABSTRACT

An apparatus and method for removing and recovering up to 98 percent of the residual drilling mud and fluids from drill cuttings for reuse and storing the drill cuttings in a relatively dry state thereby reducing cuttings volume requirements for storage and transport thereby reducing constipation of the drilling process due to disposal congestion. The present invention further provides methods for collecting and transferring drill cuttings in either dry or wet states to various locations on or adjacent the rig for processing, containerization, transport and disposal, thereby reducing handling and contamination thus simplifying recycling while reducing cost.

25 Claims, 15 Drawing Sheets

APPARATUS AND METHOD FOR TRANSFERRING DRY OIL AND GAS WELL DRILL CUTTINGS

SPECIFICATION

Field of the Invention

This is a continuation application of United Kingdom application 9913567.5 filed in the U.K., Jun. 11, 1999, now pending. Priority is claimed to PCT application No. GB 99/04097 filed Dec. 10, 1999.

This invention relates generally to handling of waste materials especially particulate solids. A method of transferring such materials from one location to another, and an apparatus suitable for performing the method, is described hereinafter. The invention finds particular utility in the oil and gas industry for disposal of well or drill cuttings ("hereinafter cuttings") discharged from the solids control system on a well drilling site.

BACKGROUND OF THE INVENTION

Cuttings are typically pieces of rock, which have been chipped, ground or scraped out of a formation by a drill bit. Various types of drill cutting tools_are in use for this purpose and the invention hereinafter described is not limited to use of any particular type.

The drilling operation is conducted several hundred meters below the operation control point, which means that performance of the drill bit is critical to the operation. The effectiveness of the drill bit during a drilling operation relies upon the continual removal of cuttings; otherwise the drill would rapidly foul up due to accumulation of cuttings. Therefore, the cuttings are normally removed by delivery of a drilling fluid (often referred to as "drilling mud") down to and around the drill bit in a recirculated manner by use of the drill string and annulus casing well established in the industry.

Accordingly the cuttings are commonly separated from the drilling fluid by devices such as a shale shaker, which captures cuttings and large solids from the drilling fluid during the circulation thereof. Basically, such a device has a sloping, close mesh, screen over which fluid returning from the hole being drilled passes. The screen may be typically of from 200×200 down to 30×30 mesh and is vibrated to facilitate separation of the majority of fluids from the solids. The solids captured on the screen travel down the sloping surface to be collected in the shaker ditch or cuttings trough. It is also desirable to recover as much of the expensive drilling fluids as possible. Therefore, other devices, which play a role in the separation of solids from drilling fluids, include cyclone separators, and centrifuges. The cuttings discharged from the shakers, cyclone's and centrifuges that are collected in the shaker ditch or cuttings trough are still highly contaminated with the drilling fluids and therefore form a slurry or heavy sludge. The slurry or sludge is very difficult to move or otherwise transfer in any conventional manner.

In some cases the cuttings slurry may be discharged directly into a cuttings box where space permits or vacuum collected, which under current practice means that the cuttings are sucked from the cuttings ditch or trough, by an applied vacuum, directly into a cuttings box for transport to an approved disposal site for re-claimation suggested in GB-A-2 286 615. However, in some cases in order to facilitate removal of the cuttings, a collection hopper may be used which allows a particular ground clearance typically of about 4 meters whereby the cuttings are discharged from the hopper by free-fall into open cuttings containers.

It is also proposed there to include another trough for intermediate collection of cuttings. A screw conveyor for lateral displacement of cuttings from beneath the intermediate trough is described. The screw conveyor pushes the cuttings, which fall into it from the trough towards a discharge trap door that opens under the weight of the cuttings to periodically allow the cuttings to fall into the holding tank.

The intermediate trough described remains under the influence of the suction pump to continue delivery of recovered fluid to a recycle system, whilst the screw conveyor below the trough shifts cuttings towards the trap door.

In a more recent operational system a vacuum cuttings hopper is provided including, a helical screw therein on a vertically arranged shaft driven by an overhead motor assists the delivery of the solids to the free-fall outlet for collection below the hopper, The cuttings are further subjected to compression by the helical screw prior to discharge thus extracting and recovering a substantial amount of the remaining fluids in the slurry. The extracted fluid is then withdrawn through a perforated casing around the screw under the action of a pump.

The problems associated with cuttings handling for disposal are familiar to all workers on a drilling installation and include the need for the presence of several storage containers to handle the volumes of cuttings produced and the time demands upon the installation's crane devoted to the shifting of a filled container to substitute an empty container close to the shaker station. This container "shuttling" routine is not only absorbing useful operational time for the crane but also presents additional physical hazards to workers involved in other tasks in close proximity to the cuttings containers. Furthermore, the cuttings recovery equipment and the containers themselves are usually accessed by workers scaling ladders, or scaffolding or the like staging up to heights often approaching 5 or 6 meters or thereabouts in order to open container lids or service the cuttings handling equipment. Of necessity the containers themselves must be sited close to the cuttings shaker station and be accessible by the crane. These factors have an impact on use of deck space, personnel mobility, and other task completion operations around the deck.

Further the filling and relocation of cuttings containers is dictated by the volume of cuttings being produced by the drilling operation in any given period of time. Therefore, it is essential that the cuttings handling apparatus and its methods of operation be capable of handling the volumes required to maintain production.

An object of the present invention is to provide improvements in cuttings handling for disposal and recovery of reusable drilling fluids and muds from the drill cuttings slurry thereby reducing cost of disposal and recycling. A object fulfilled by aspects of the invention to be described hereinafter is to provide a drill cuttings recovery system of more compact or efficient design.

A still further object is to provide a more flexible disposal method allowing the operator greater degree of freedom in the options for handling the cuttings prior to disposal.

Generally the invention seeks to provide a system and method for handling of cuttings, which offers an improved alternative to current handling systems.

The invention, according to a first aspect, provides a method for handling cuttings that includes providing a system utilizing a screw pump to remove the cuttings from the cuttings trough and disperse them through a piping system to various disposal points.

The invention according to another aspect, provides a method for handling of cuttings, which method comprises providing a vessel adapted to sustain a reduced internal pressure with respect to external ambient atmospheric pressure, and external pumping means, said vessel and pumping means being operationally connected by means including a conduit, collecting cuttings from a drilling fluid/cuttings separation device in said vessel, removing cuttings from said vessel by means of said pumping means through said conduit whilst maintaining a reduced pressure, and selectively delivering removed cuttings by means of pumping to at least one of a variety of disposal points including a cuttings re-injection apparatus, removable transportable cuttings containers including a barge or the like for shipping to a remote disposal site.

According to another aspect of the invention there is provided an apparatus for handling of cuttings, comprising a vessel adapted to sustain a reduced internal pressure with respect to external ambient atmospheric pressure, and further provide a means for extracting fluids, the apparatus also having operationally connected thereto, external pumping means capable of maintaining the reduced internal pressure and removing the separated fluids while discharging the cuttings to a variety of storage containers or to a cuttings re-injection apparatus.

In accordance with still another aspect of the invention a centrifugal dryer is provided for drying the drill cuttings prior to distribution, by way of a blowers and or vacuum systems, to various holding containers located on or near the rig. This drying process removes the fluids and thereby allows all of the cuttings being produced by the drilling operation to be contained on the rig for longer periods of time prior to removal or re-injection.

Significantly, according to the invention, the proposed use of the pumping means for not only initially collecting the cuttings under vacuum, but also removing cuttings under reduced pressure or "vacuum" conditions, and utilizing the pumping means to selectively convey the cuttings onwards via dedicated conduits to a cuttings storage container, or directly into a cuttings re-injection facility, offers several significant advantages.

Firstly, the demands on the crane are reduced because the cuttings containers do not need to be continually cycled around for filling and emptying operations. The containers can be stowed or sited in convenient locations without taking account of the shaker station position other than to ensure that suitable vacuum conduit lines are available or provided to feed the cuttings directly into the containers. The crane then becomes essentially free to fulfill other essential tasks such as handling drill pipe etc. The freedom to locate containers anywhere that a cuttings vacuum transport line can be installed and accessed immediately also provides greater freedom on the deck for operator movement, and greater flexibility in utilization of deck space around the shaker station and elsewhere.

Secondly it offers the possibility of directly off-loading cuttings to a barge or bulk transport ship standing on station close to the drilling facility.

Thirdly, health and safety aspects are enhanced due to reduced contact between workers and the cuttings, who need longer clamber over the cuttings containers to access them thereby reducing contamination hazards and risks of personal injury by falls.

The conduit network may be a fixed installation or arranged so as to permit re-deployment of a selected or each conduit at will. The conduits are designed sufficiently to permit transfer of the particulate solids constituting the cuttings and avoid blockages, and pump overloading but are also sized to avoid loss of vacuum transfer velocity.

It will be understood that the pumping means referred to herein in relation to the various aspects of the invention may consist of one or more pumps having the necessary functions of generating a pressure differential to move cuttings in the desired way and combinations of pumps can be adopted.

Preferably, the pumping means comprises, at least, (i) gas pumping means e.g. a vacuum generating unit capable of creating the desired pressure reduction in the vessel and (ii) a solids displacement means, which may be one of several types suitable to the purpose, including positive displacement pumps, e.g. a piston pump, or paddle devices e.g. using rubber paddles, or a progressive cavity pump capable of continuous displacement of solids, preferably at about 25 tons per hour or more. Advantageously, location of the pumping means external to the vessel is such that solids displacement is so primarily lateral rather than vertical as required for the known solids free-fall under gravity system, which reduces height requirements The vessel can then be installed at ground (deck) level with no height elevation requirements which improves safety for operatives.

In this way equipment provided in accordance with the invention can exhibit a relatively low profile compared with prior art systems and is more easily installed and maintained by operatives with less risk of injury due to falls. Furthermore in contrast with the prior art operational system described above where the vertically arranged helical screw is within the cuttings hopper itself, the pressure vessel arrangement described herein is less complicated in structure and provides for easier care and maintenance operations.

Overall, the system proposed herein results in more efficient use of space in the installation, and reduces hazards associated with earlier systems.

The vessel and pumping means described herein are operationally connected so as to maintain a reduced pressure or vacuum within the system, which may be achievable by fastening arrangements satisfying usual industry pressure vessel standards, including flanged connections and dedicated hard conduits of adequate strength. The reduced pressure can be maintained by a suitable type pump known in the industry or custom built for this system.

It will be understood that primarily the invention addresses solids handling, and the precise nature of the vacuum unit or gas pump is not critical. The arrangement of the invention is such that the pumped cuttings can either be directed from the reduced pressure vessel into appropriate storage facilities such as containers or directly into a cuttings re-injection device enabling the cuttings to be returned to the drilled formation. Furthermore the cuttings can be "piped" off the installation into a barge or similar bulk cargo transporter.

Cuttings re-injection under high pressure back into an earth formation is described in principle in the following U.S. Pat. Nos. 4,942,929, 5,129,409, and 5,109,933, and treatment of drill cuttings is discussed in the following U.S. Pat. Nos. 4,595,422, 5,129,468, 5,361,998 and 5,303,786. However, these early proposals have not been easy to implement in the field for those lacking the appropriate skill and understanding, and this has resulted in cuttings re-injection not gaining wide acceptance amongst operators, especially in offshore drilling installations in the North Sea.

The present invention arises from developments following on from proven re-injection techniques successfully employed by APOLLO Inc. in offshore drilling operations.

DESCRIPTION OF THE DRAWINGS

The invention will now be further described with reference to the accompanying drawings in which.

DETAILED DESCRIPTION

Figure 1:
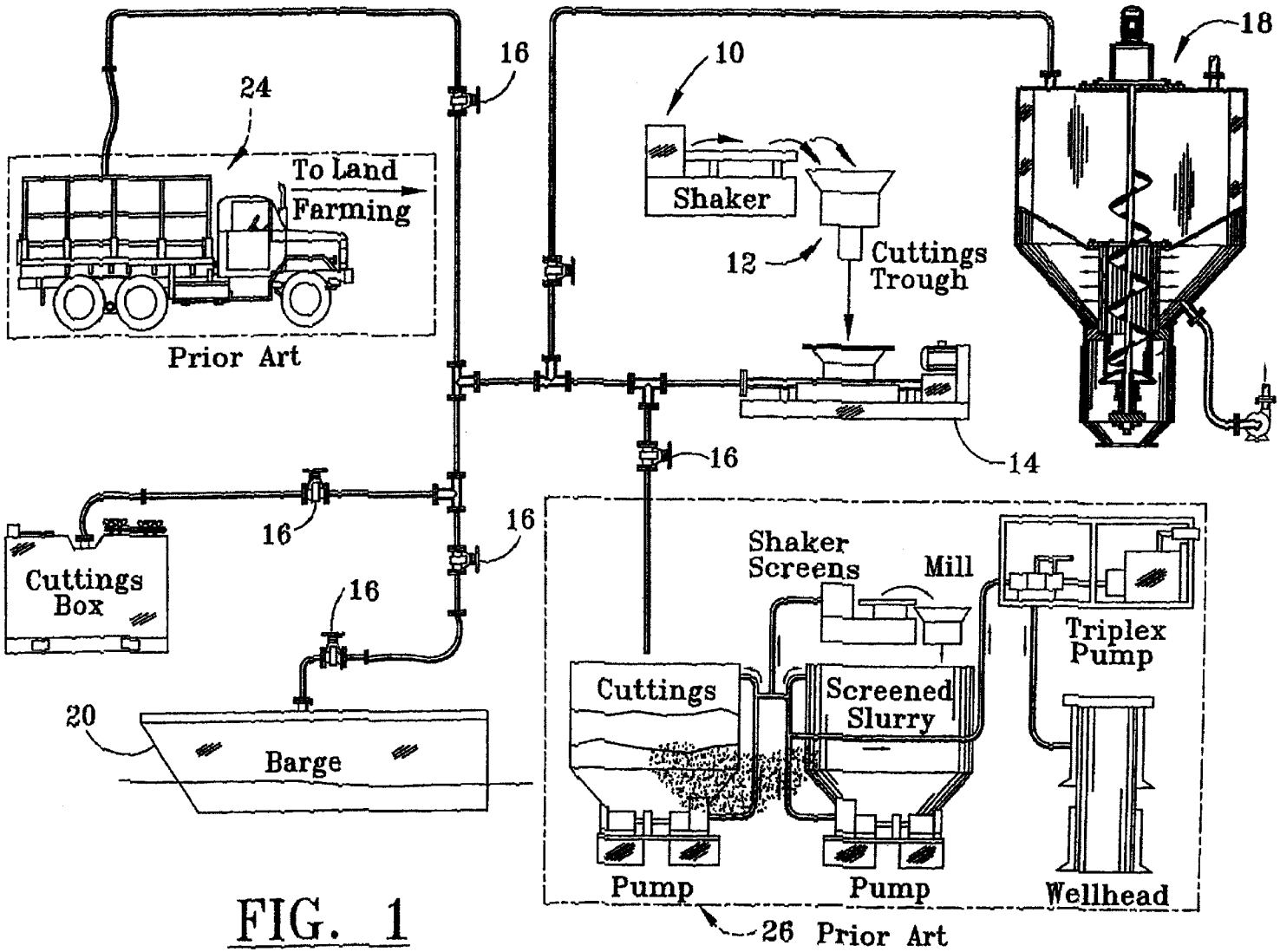
FIG. 1 is a plumbing illustration arrangement for the preferred embodiment of the materials handling system.

As shown in FIG. 1, the preferred embodiment of the invention is a system by which cuttings leaving the shaker 10 may be collected from the cuttings trough 12 by gravity feed into a progressive cavity or fixed displacement piston type solids pump 14 and then pumped through a system, of conduits selectively to one or more of the possible discharge ports or disposal points located around the drilling site or platform. Such disposal points or discharge ports may be selected by opening valves 16 as needed to dispense the cuttings to a cuttings/fluid separator 18, a barge 20 a cuttings box 22 or other transport means such as a truck 24 for further disposition.

Figure 3:
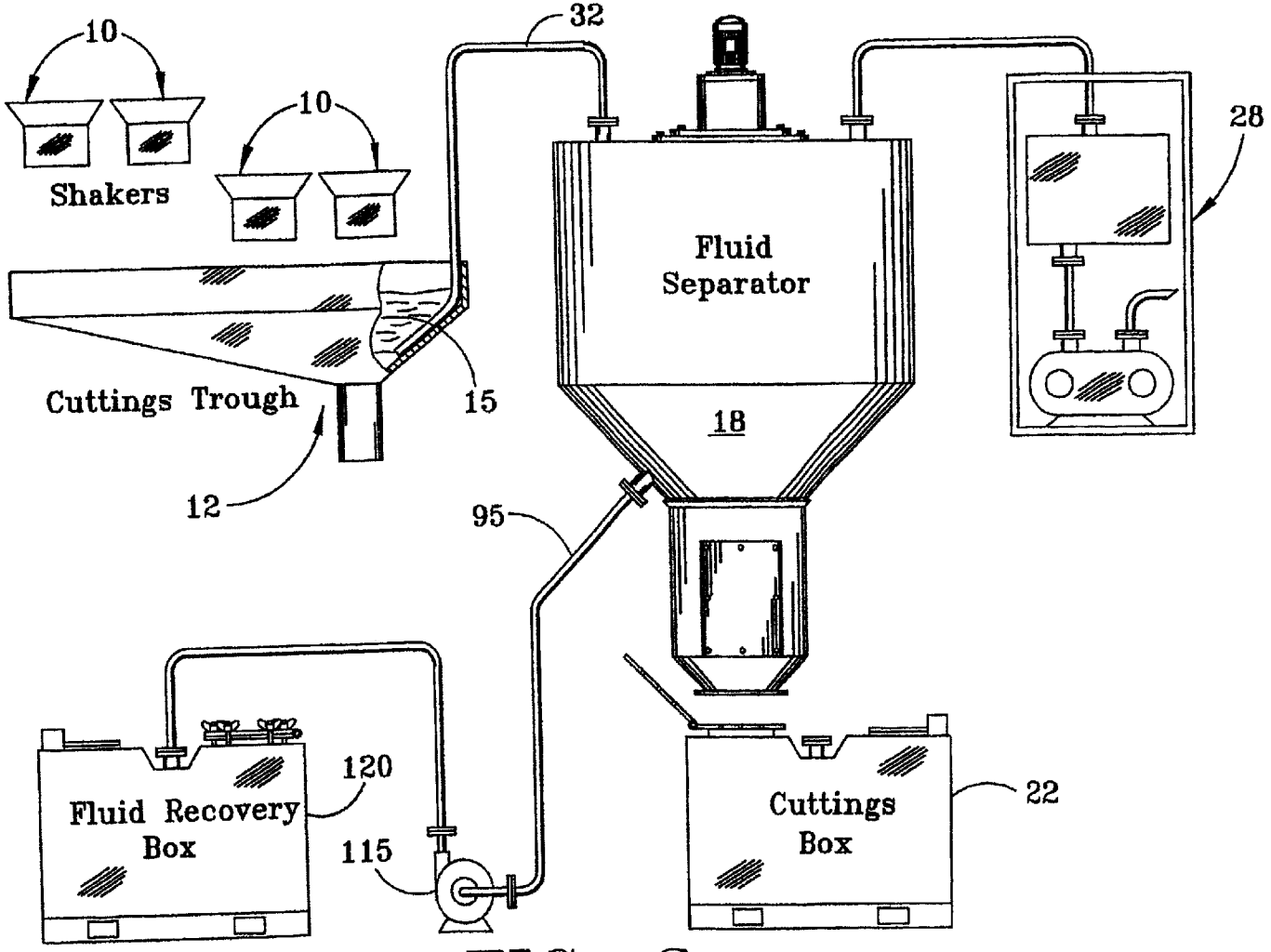
FIG. 3 is a plumbing illustration arrangement for an alternate vacuum system.
Figure 5:
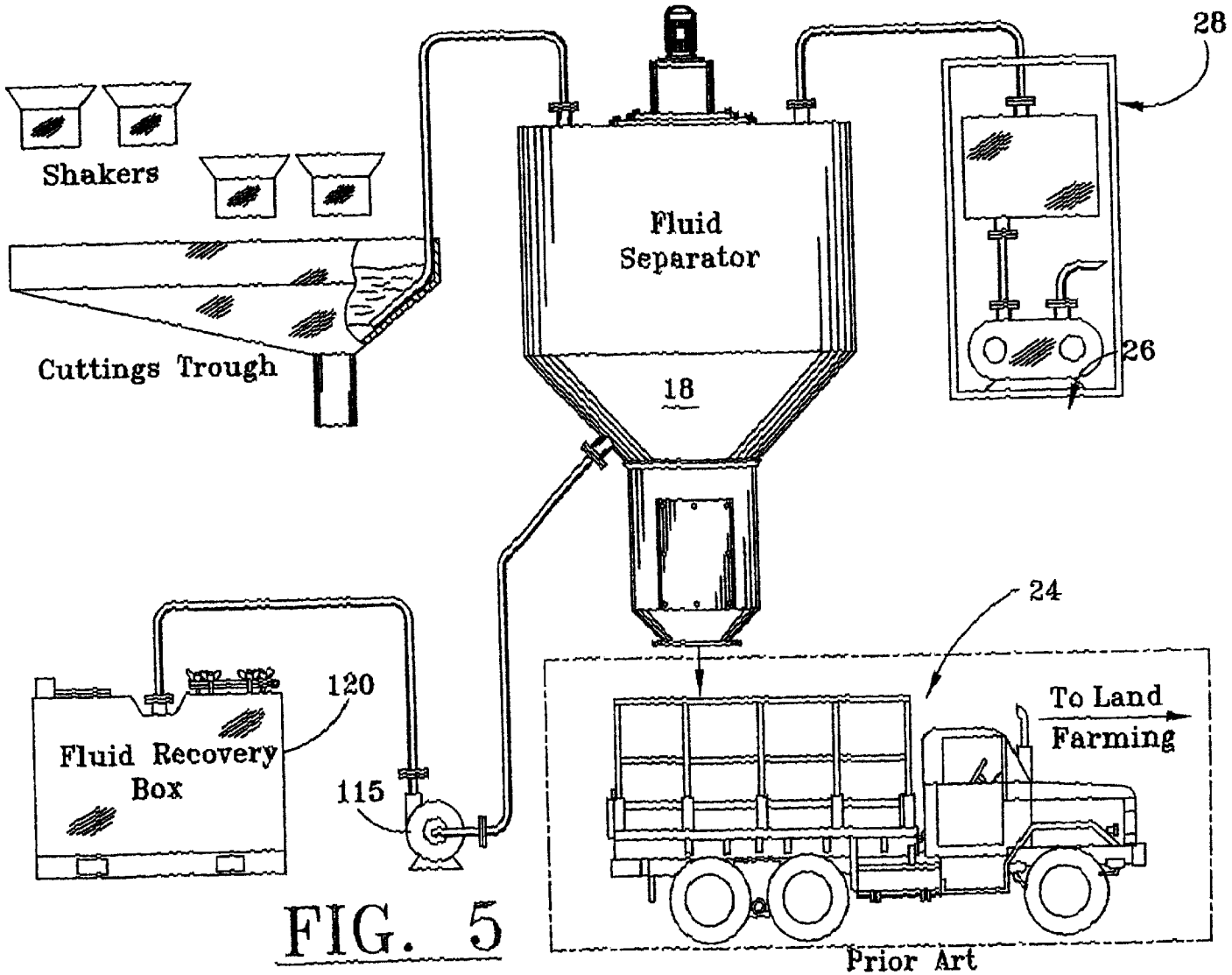
FIG. 5 is a plumbing arrangement and an optional discharge receptacle for the system shown in FIG. 3 system.

Defluidized cuttings discharged from the separator 18 may be collected in various containers such as a cuttings box 22 seen in FIG. 3, a truck 24 as seen in FIG. 5 or into a slurry processing unit 26 for injection into the earth formation around the well as also seen in FIG. 1.

Figure 2:
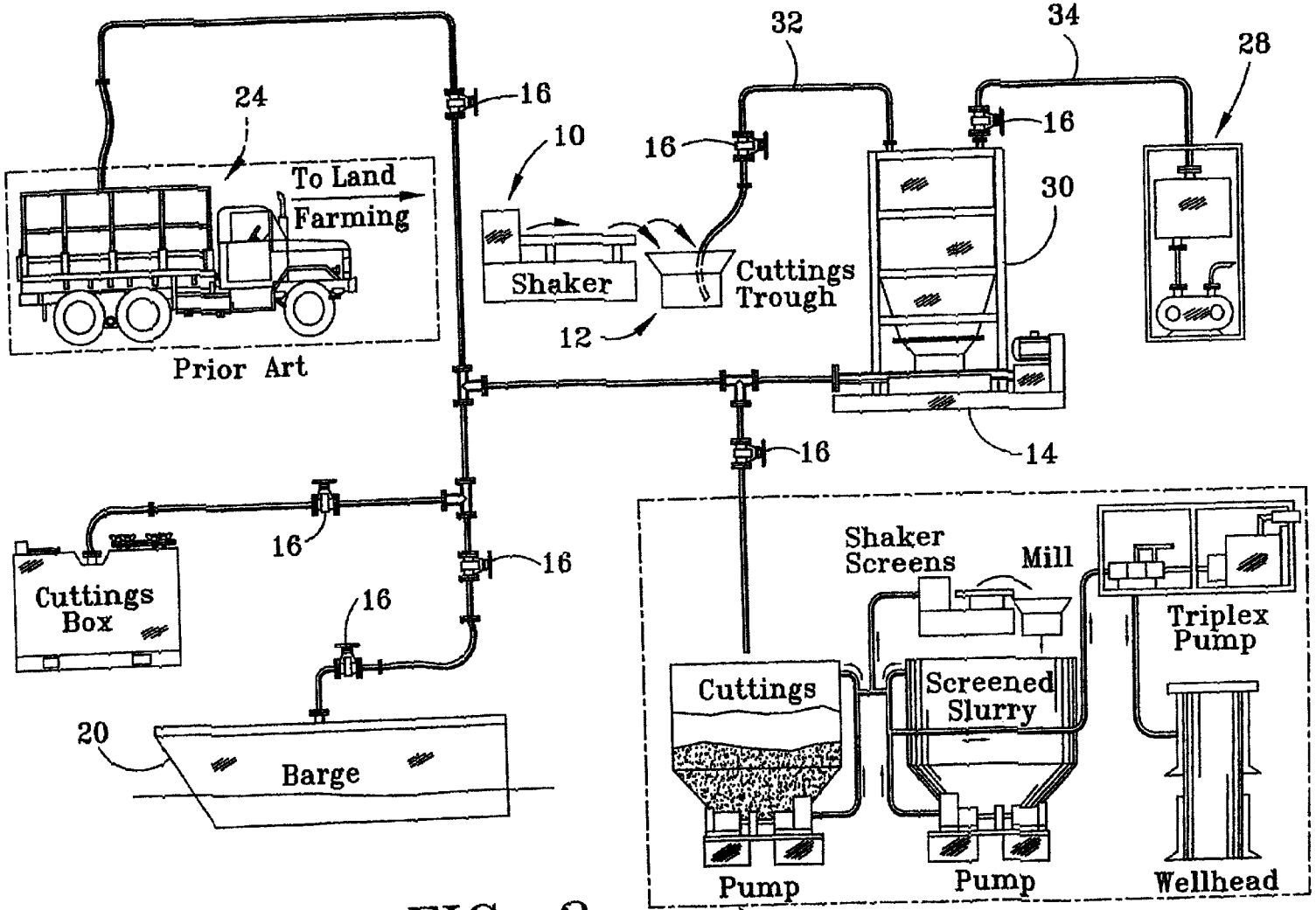
FIG. 2 is a plumbing illustration arrangement for an alternate embodiment of the preferred system.

By adding a vacuum pump unit 28 and vacuum chamber 30 as seen in FIG. 2 to the solids pump 14 and its associated system shown in FIG. 1 the system is then capable of extracting the cuttings from the cuttings trough by vacuuming them directly into the chamber 30 which serves as a hopper for feeding the cuttings to the solids pump 14. As discussed herein this arrangement is useful when space under the cutting trough is insufficient to accommodate the solids pump 14. Since the cuttings are still in slurry they can be pumped to the various discharge points. However, once the fluids have been extracted by the separator 18 it is much more difficult to move the materials without adding more fluid. Therefore, the defluidized cuttings are discharged from the separator 18 directly to the containers 22,24 or to the injection processing unit 26 as disclosed in FIGS. 3–5.

Turning now to FIG. 3 we see that the previously known fluid separator 18 may also be used as the vacuum chamber for extracting the cuttings directly from the cuttings trough 12. However, the separator has the distinct advantage of being capable of efficiently removing and reclaiming most of the remaining fluids from the cuttings thereby reducing the weight and volume of the cuttings to be transported.

Figure 6:
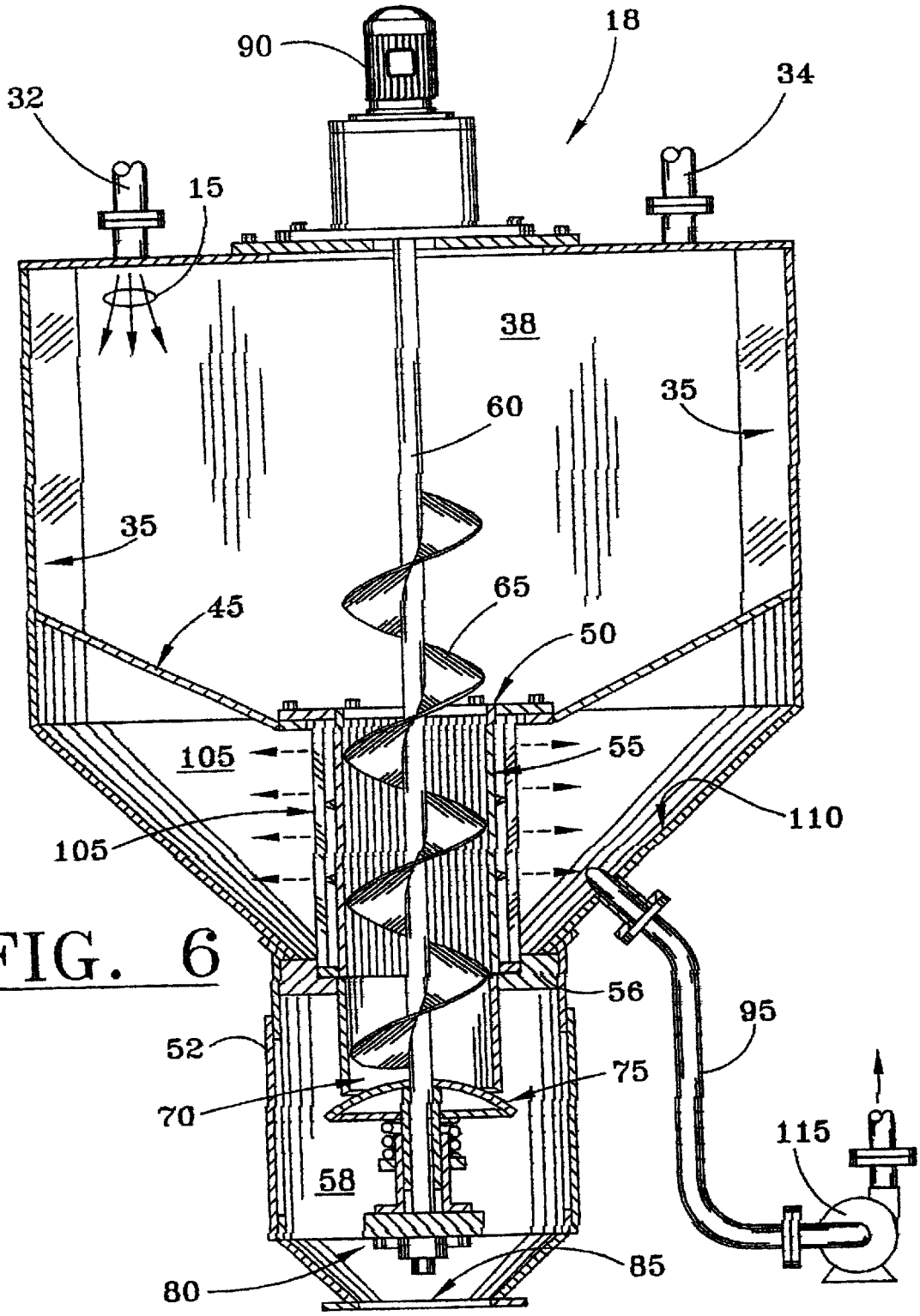
FIG. 6 is a cutaway side elevation of a low profile reduced pressure vessel and associated pumping means in accordance with the invention.

As shown in FIG. 6, the previously known operational fluid separator system 18 collects cuttings 15 from the cuttings trough 12 that collects solids falling via gravity from inlet suction line 32 as a result of the separator having a reduced internal pressure created by the gas suction pump system 28 seen in FIG. 2 attached to the separator by line 34. The separator 18 is generally diametrical in shape having cylindrical side walls 35 and a top 40 with a sloping mid portion 110 and a smaller cylindrical lower portion 52 culminating at an open discharge port 85. The interior is divided into an upper chamber 38 bound by side wall 35, top 40 and inclined partition 45, a mid chamber 105 bound by the inclined partition 45 sloping side wall 110 and partition 56 and a lower chamber 58 within the smaller cylindrical lower portion 52 serving as the housing for an adjustable valve assembly 75.

The upper chamber communicates with the mid and lower chambers 105, 58 with screen assembly 50. Positioned substantially central along the vertical axis of the screen member 55 is a shaft 60, which supports a screw conveyor driven by a motor drive 90. The screw flight portion 65 extending from the upper chamber through the screen assembly 50 and culminating at the screen discharge end portion 70 which is substantially blocked by valve assembly 75.

Figure 4:
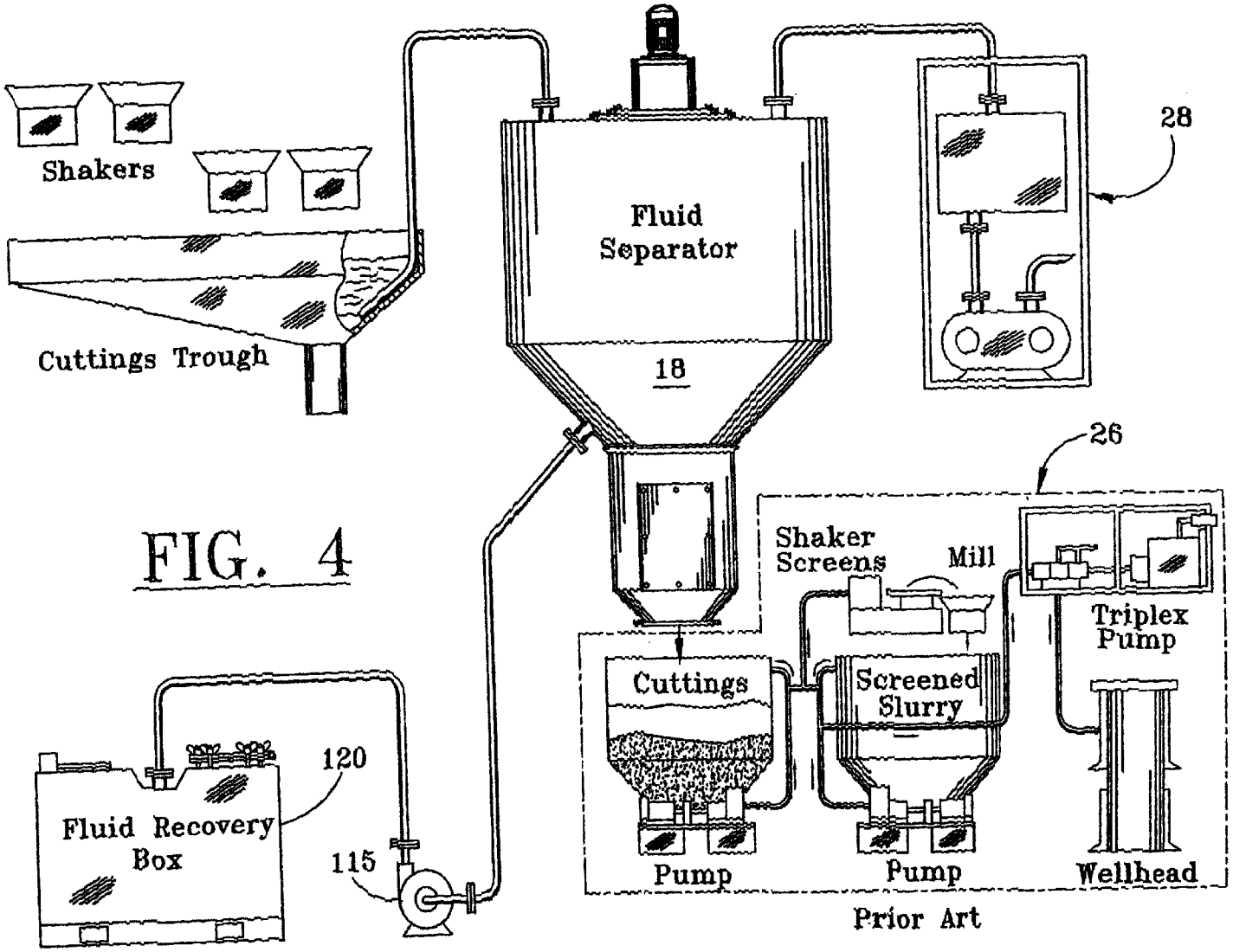
FIG. 4 is a plumbing arrangement and an optional discharge receptacle for the system shown in FIG. 3 system.

Cutting being conveyed from the upper chamber 38 to the discharge port 70 must force the valve open to allow the cuttings to 15 to communicates with lower chamber 58 and be discharged through the discharge chute 80. Chute 80 empties into opening 85 which disposes cuttings into a container as seen in FIGS. 3–5.

The side walls 35, inclined walls 45, and screen assembly 50 communicate and form a seal with the screw flighting 65 and the mid chamber 105 so that when a vacuum is applied using suction line 34, cuttings can be suctioned from trough 12 to the upper chamber 38 of the separator and then conveyed through the screen assembly 50 to wards the closed valve assembly 75 thereby compressing the cuttings 15 and forcing fluids and solids less than 20 micron through the screen 55 and apertures in screen sleeve member 100. Fluids accumulated in the mid chamber 105 are then drawn off by pump 115 to be a fluids recovery container 120 via discharge line 95. The remaining solids are disposed of via discharge valve assembly 75 and travel down the discharge chute 80 under gravity and are emptied into containers via the opening 85 where they await disposal or re-injection.

Figure 7:
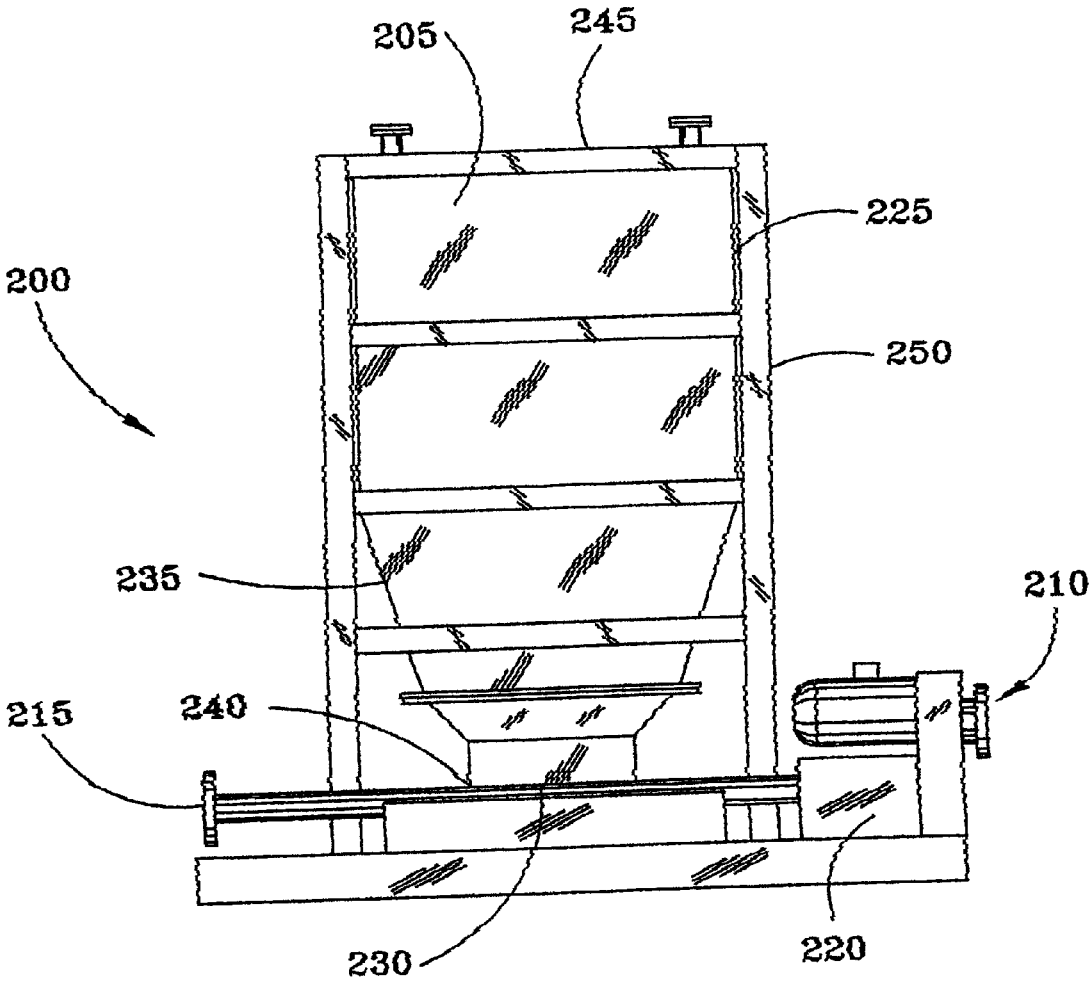
FIG. 7 is side elevation of a low profile reduced pressure vessel and associated pumping means in accordance with the invention.

The reduced pressure vessel 30 first illustrated in FIG. 2 and further detailed in FIG. 7, illustrating this aspect of the invention, there is shown a relatively low profile reduced pressure vessel 205 and associated pumping means 210 in accordance with the present invention. The apparatus 200 for handling of cuttings comprises a vessel 205 adapted to sustain a reduced internal pressure with respect to external ambient atmospheric pressure, and operationally connected thereto, external pumping means 210 capable of both operations of maintaining the reduced internal pressure and removing cuttings from the vessel 205, and means including a conduit 215 for selectively delivering cuttings to either a storage facility or to a cuttings re-injection apparatus. (not shown)

The illustrated vessel 205 has four generally rectangular sides 225, which communicate with an opening 230 via inclined walls 255 and a delivery chute 240. The vessel 205 also has a rectangular top cover 245. The vessel 205 is supported by a framework 250 to which it is attached, e.g. by welds. However, it will be appreciated that other shapes of sealed pressure vessel can be adapted in the invention. The system described here is designed to fully satisfy current industry pressure vessel standards.

The pumping means 210 illustrated comprises a progressive cavity pump 220 capable of continuous displacement of solids, here at about 25 tons per hour or more. Other positive displacement pumps may also be used, Location of the pumping means 210 external to the vessel 205 is such that solids displacement is primarily lateral rather than vertical as required for the known solids free-fall under gravity system which provides for low height requirements. The vessel 205 is installed at ground level with no height elevation requirements. In this way the equipment has a low profile and is more easily installed and maintained with less risk to maintenance technicians or other operatives of falling.

Furthermore in contrast with the prior art operational system described above where the vertically arranged helical screw is within the vessel itself, the arrangement described herein is less complicated in structure and provides for easier care and maintenance operations.

The vessel 205 and pumping means 210 described herein are operationally connected so as to maintain a reduced pressure be low atmosphere or vacuum within the system, which may be achievable by fastening arrangements satisfying usual pressure vessel standards, including flanged connections 240 and dedicated hard conduits of adequate strength. The reduced pressure can be maintained by a vacuum pump of any suitable type, and although illustrated here as having both gas and solids pumping means together, the gas (vacuum) pump could be remote from the solids pump. The arrangement of the invention is such that the pumped cuttings can either be directed from the reduced pressure vessel 205 into appropriate storage containers or directly back into a cuttings re-injection device as a matter of operator's choice, as is apparent from the flow illustration seen in FIGS. 1 and 2.

Figure 8:
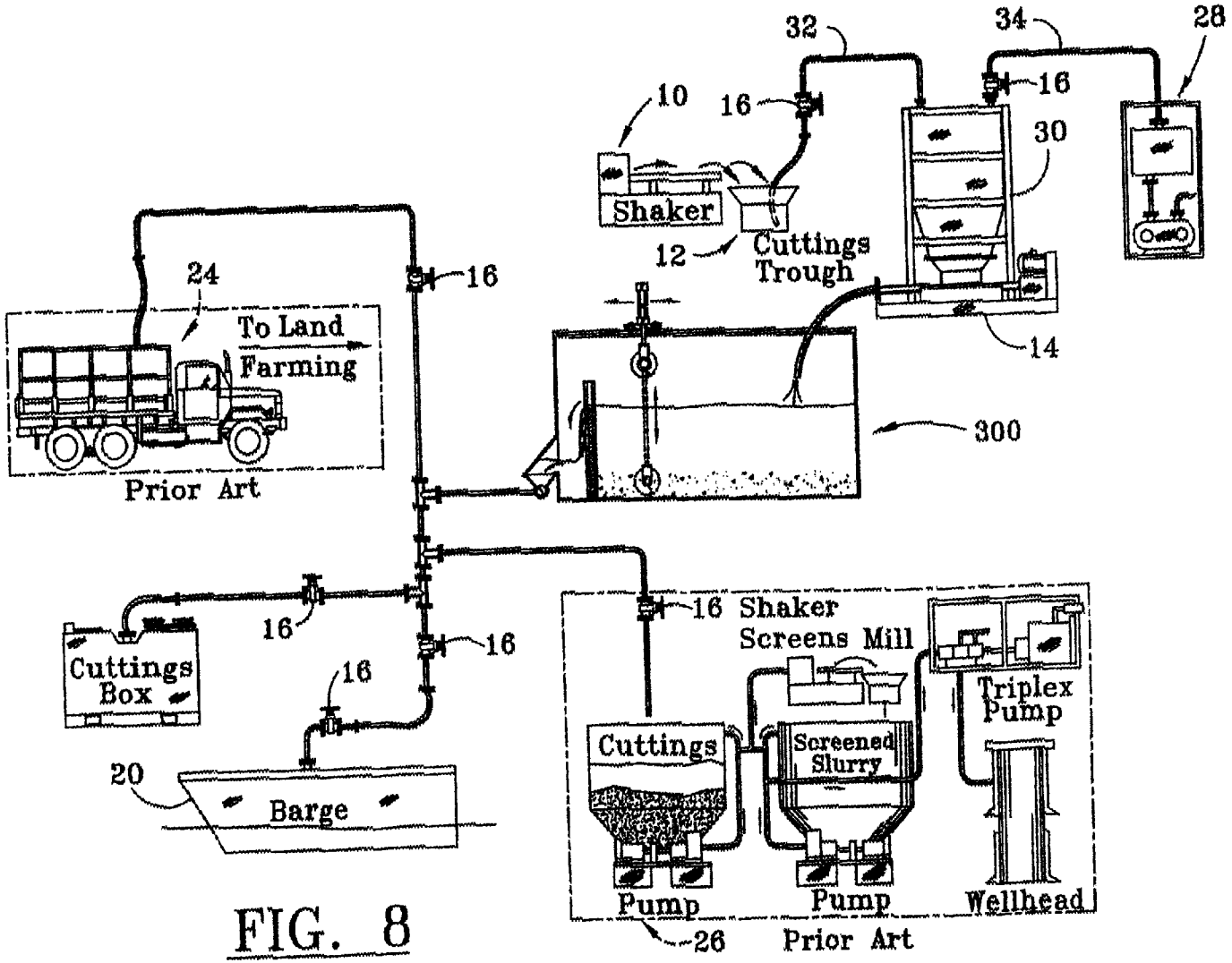
FIG. 8 is a plumbing arrangement for the system shown in FIG. 2 adding an optional surge tank.

As seen in FIG. 8 the cuttings handling system may also be configured to include a surge or holding tank 300 whereby the cuttings slurry being discharged from the pump 14 is received and held for selective redistribution and pumping to the various containers and systems around the drill site. This surge tank 300 may be necessary to insure that the system does not become constipated and back up as result an inability to discharge the cuttings freely to a container.

Figure 9:
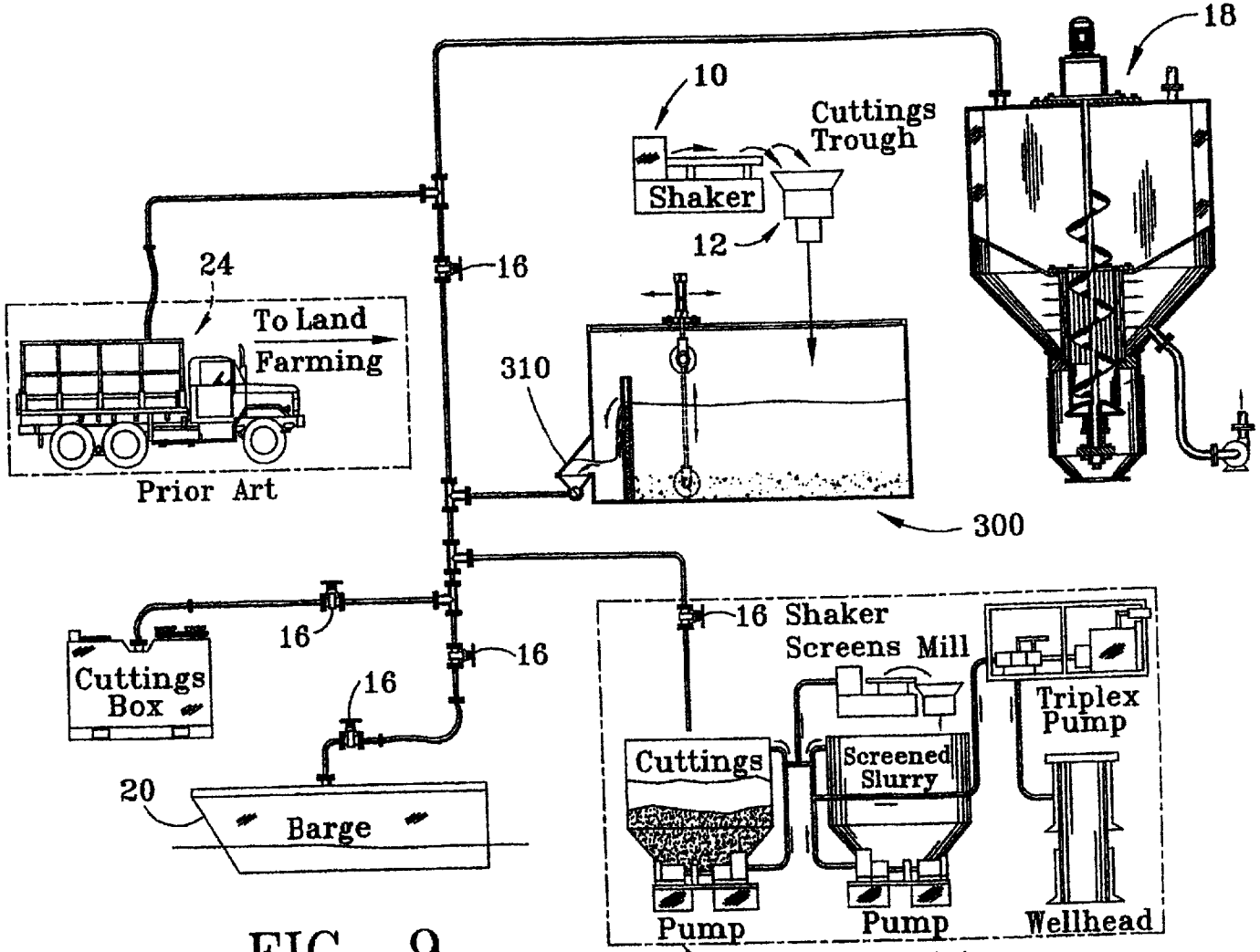
FIG. 9 is a plumbing arrangement for the system shown in FIG. 1 with addition of an optional surge tank and pump combination.

As seen in FIG. 9 the surge tank 300 which includes an integral progressive cavity pump 310 may also be used as the prime pump system whereby the cuttings are received directly from the shaker screens 10 or from the shaker trough 12 by gravity feed. The cuttings are then agitated and maintained in solution until pumped down stream to the site containers or other systems.

Figure 10:
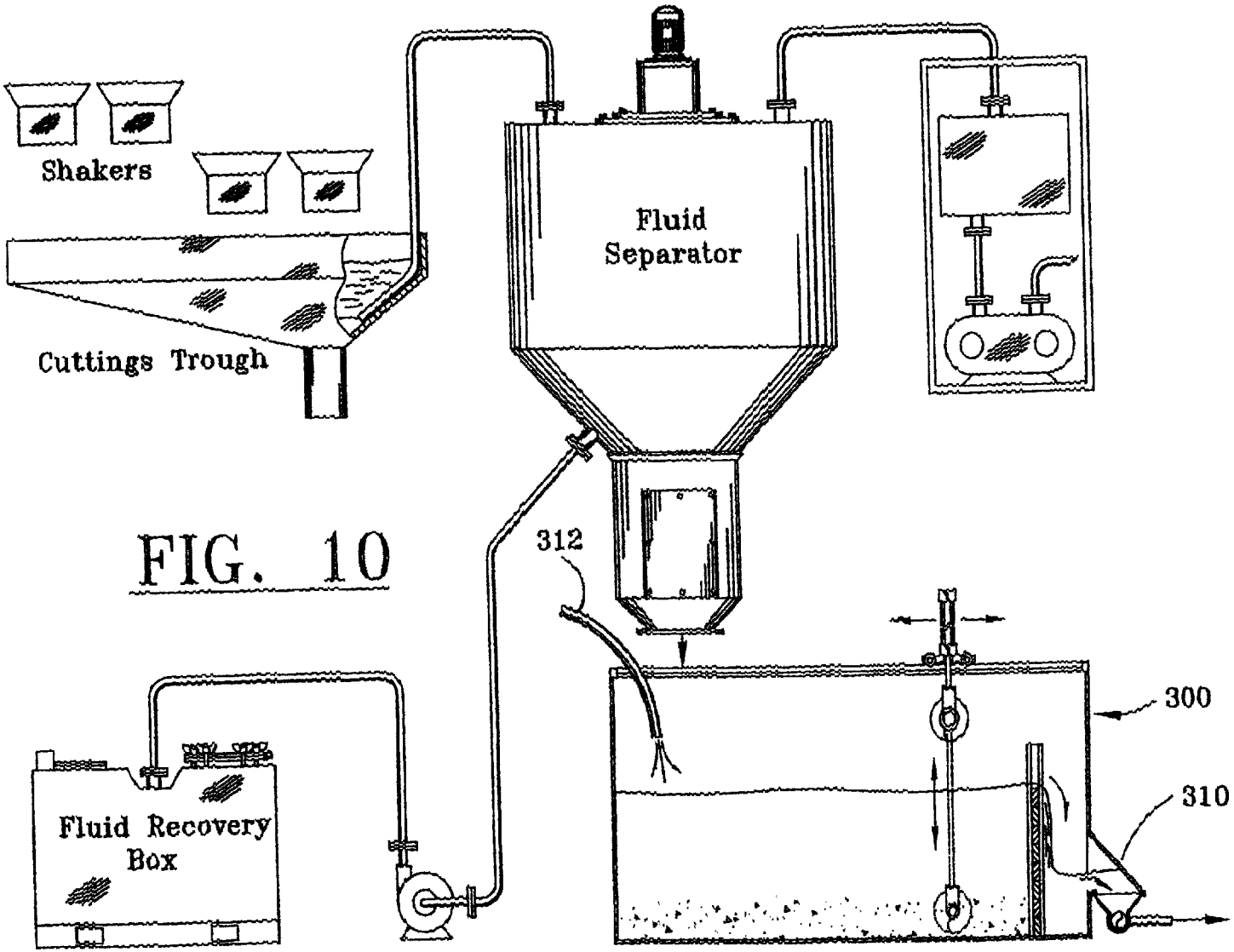
FIG. 10 is a plumbing arrangement for the system shown in FIG. 5 with separator discharging into a surge tank.

As seen in FIG. 10 it is also possible to locate the surge tank 300 in position to receive cuttings directly from the cuttings fluid separator 18. In this case the cuttings have been striped of their valuable drilling fluids and recovered. Therefore, the cutting may be discharged into the surge tank where water or other environmentally adaptable fluids are added through conduit 312, which help prepare the cuttings for earth reclamation prior to discharge to the cuttings container and systems.

Figure 11:
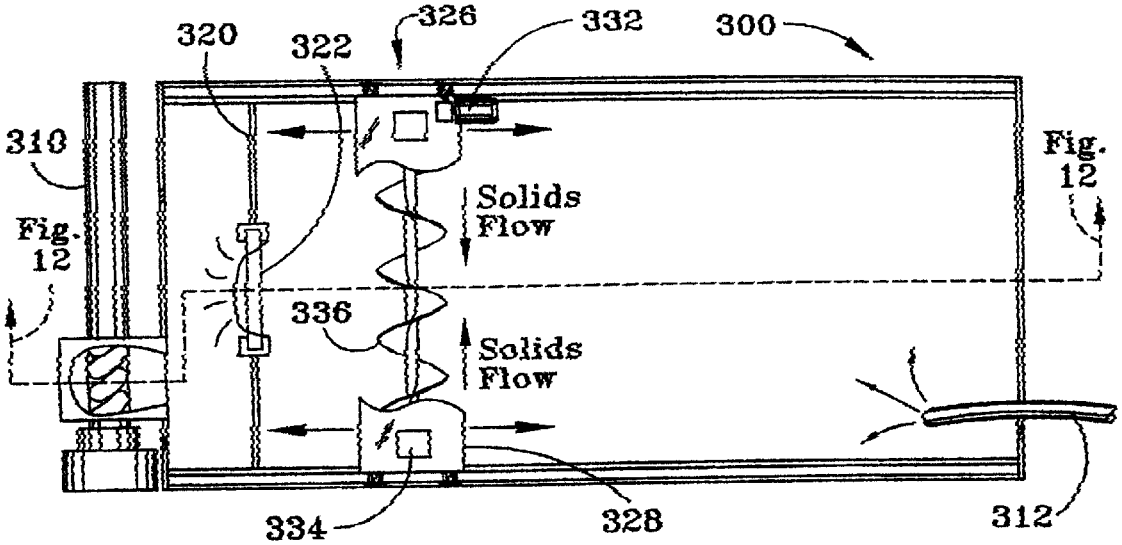
FIG. 11 is a top view of the surge tank.
Figure 12:
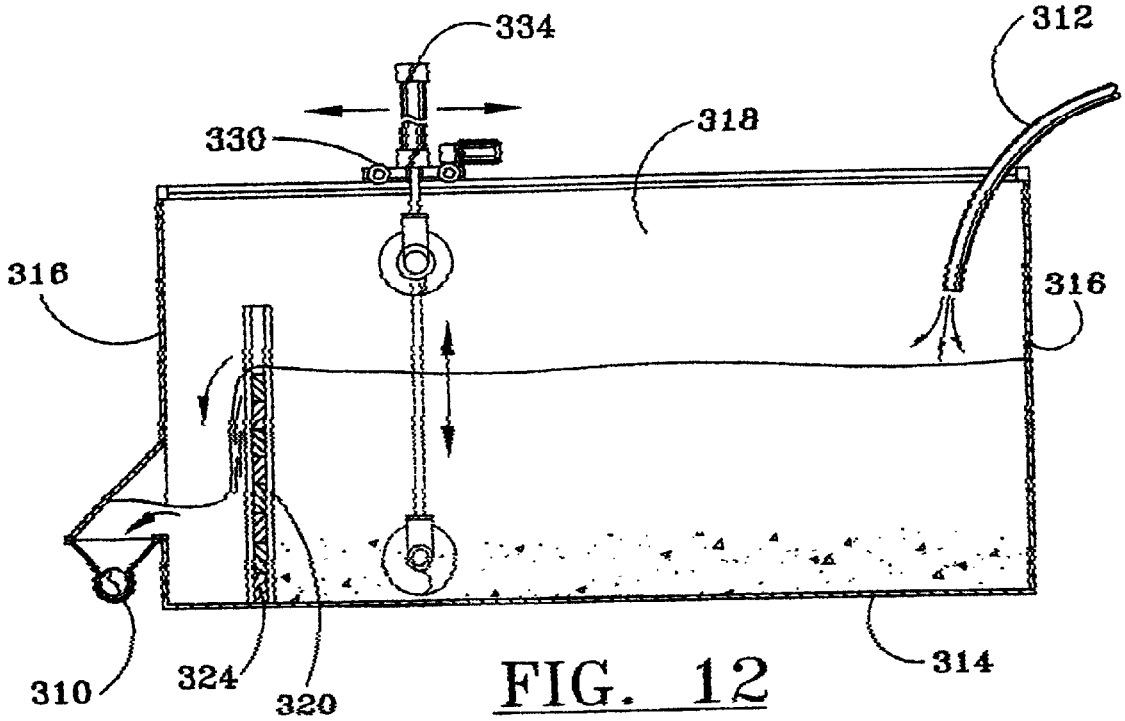
FIG. 12 is a cross section view of the surge tank.

As seen in FIGS. 11 and 12 the surge tank 300 includes a rectangular vessel having a bottom 314 and side and end walls 318,316. A progressive cavity or other such large volume positive displacement type pump is integrated into one end wall as best seen in FIG. 12. A partition 320 having a central gate portion 322 with removable portions 324 to allow for control of fluid/sediment levels within the vessel. An agitation system 326 is also provided which is trackable on wheels along rails attached to the upper sides of the tank walls 318. The agitator includes a bridge 328 supported by wheel assemblies. A drive 332 is also provided for moving the bridge 328 from one end of the tank to the other. A pair of telescopic cylinders 334 is provided for extending and retracting a centralizing screw conveyor auger 336. The auger serves to move the cuttings toward the center of the tank and help maintain them in solution so that they will flow over the partition gate 322.

Figure 13:
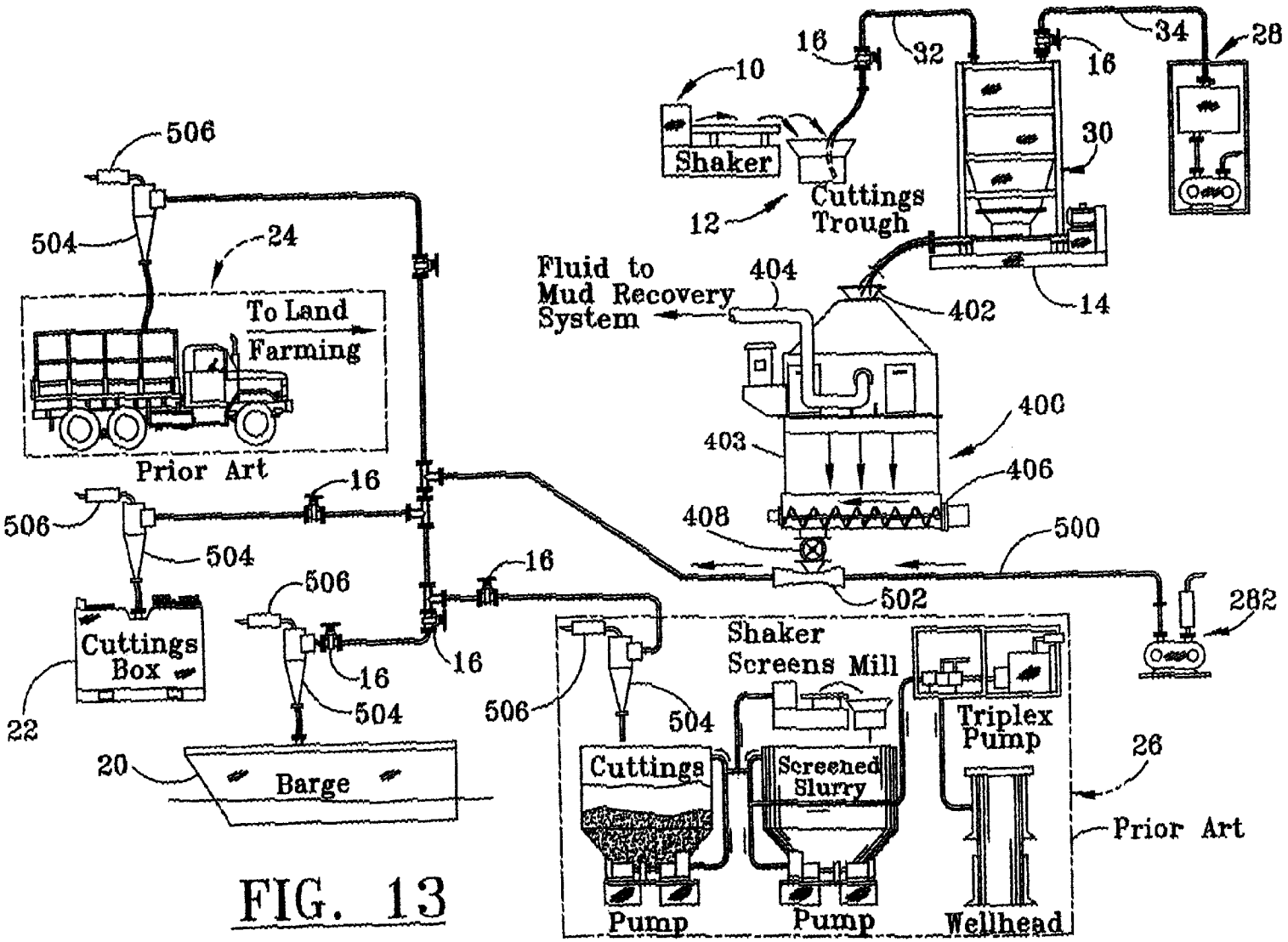
FIG. 13 is a plumbing arrangement for the system first shown in shown in FIG. 8 substituting a centrifugal dryer for the surge tank.

In off-shore drilling, it is essential that digestion and disposal of the drill cuttings flowing from the well at inconsistent flow rates be processed and disposed of in a manner that prevents constipation of the drilling operation. Therefore, the more alternatives available for cuttings disposal and fluid recovery on a drilling rig the better. In keeping with this principle alternatively, a centrifugal dryer 400 may be adapted to the systems as previously illustrated in FIGS. 1 and 2 in the manner illustrated in FIGS. 13 and 14. As seen in FIG. 13 cuttings are transferred to the vacumn receiving tank and pump assembly 30 through suction line 32 from the cuttings trough 12 in the same manne as in FIG. 12. The cuttings are then transferred from the vacuum chamber 30 with the pump 14 and deposited into the inlet 402 of the centrifugal dryer 400 where the cuttings are spun at high speed forcing the fluids from the slurry out though the fluid ejection tube 404. The relatively dry cuttings, typically below 3% fluid by weight, are then deposited into a receiving bin 403 capable of storing large quantities of the dried cuttings before being discharged by way of the transfer conveyor 406. The transfer conveyer may also contain a metering feeder 408 with internal seals to prevent back flow of the dried cuttings, prior to feeding the cuttings into the transfer line 500. The transfer line 500 may be charged with an additional blower 28*a* such as that used in assembly 28 previously disclosed herein. A venturi located within jet pump 502 may be used to help draw the dry cuttings into the charged discharge line 500. Dry cuttings are then directed to any of several optional outlets leading to receiving units 20–26 by opening and closing valves 16. Cyclone separators 504 are located at each of the receiving units for separating and exhausting the pressurized air prior to discharge into the receiving units. Exhausted air may be discharged to atmosphere through exhaust/filter units to remove fine cuttings particles.

As seen in FIG. 13 dried cuttings may be transferred directly from the transfer conveyor 406 to transfer lines leading to the optional outlets 20–26. In this case a second vacuum pump 28 is collectively connected to the discharge of each cyclone separator 504 located at each of the optional distribution outlets 20–26 thereby drawing the cuttings through the distribution lines. In this case any airborne fines are collect in the filter receiver 510 located inline ahead of the vacuum pump 512.

Figure 14:
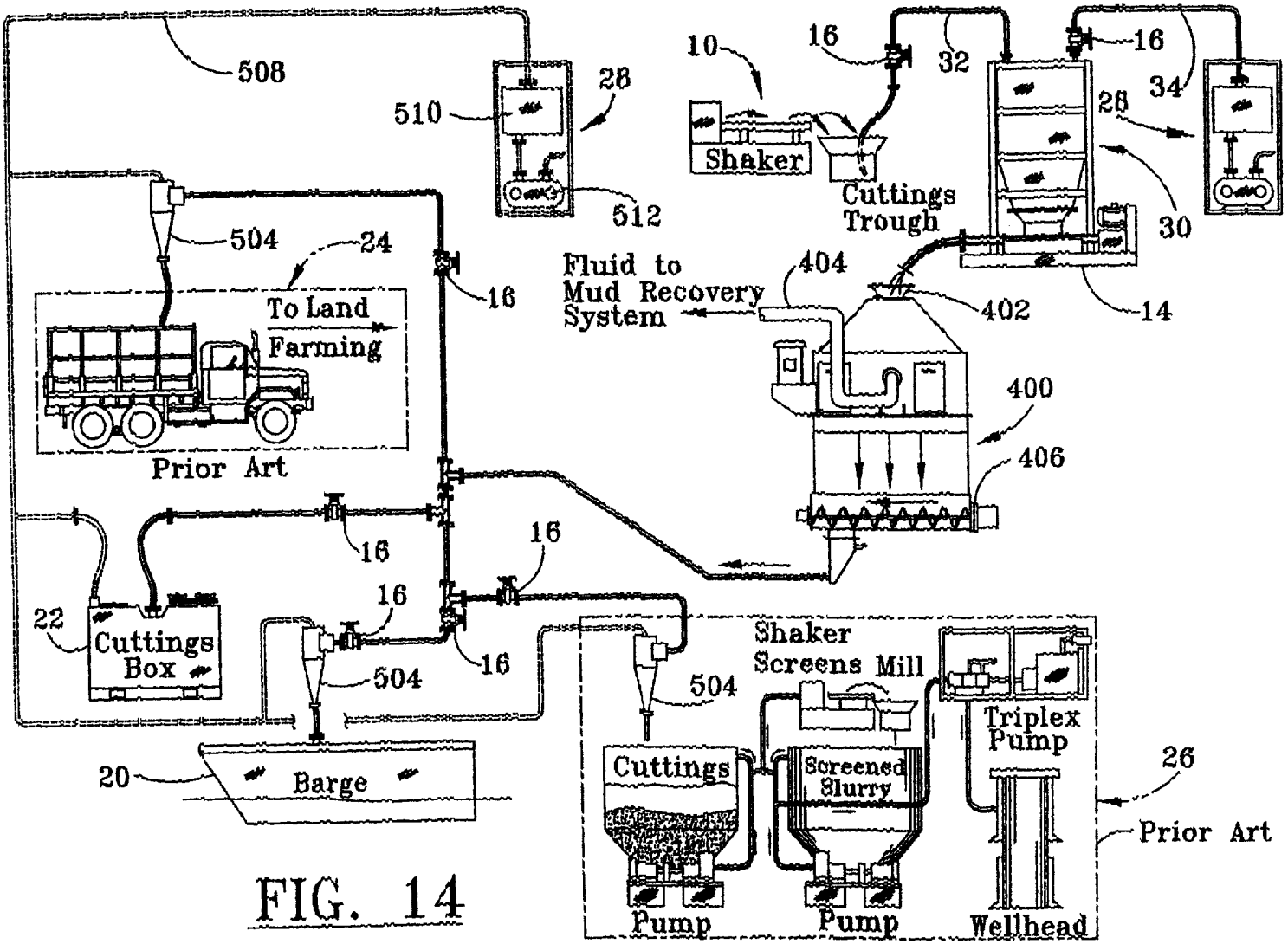
FIG. 14 is a second embodiment of the plumbing arrangement for the system shown in FIG. 13.

As seen in FIG. 14 a primary and secondary means of fluid separation and recover may be used whereby the fluid separator unit 18 is utilized as the vacuum chamber for vacuuming the cuttings from the cuttings trough regardless of whether or not the cuttings compression feature of the separator is utilized or not. However, if the cuttings compression and fluidseperation feature is utilized the cuttings will enter the inlet of the centrifical dryer unit 400 with less moisture content, thereby insuring a more through recover of drilling fluids and muds and dryer cuttings being fed to the cuttings transfer system.

Figure 16:
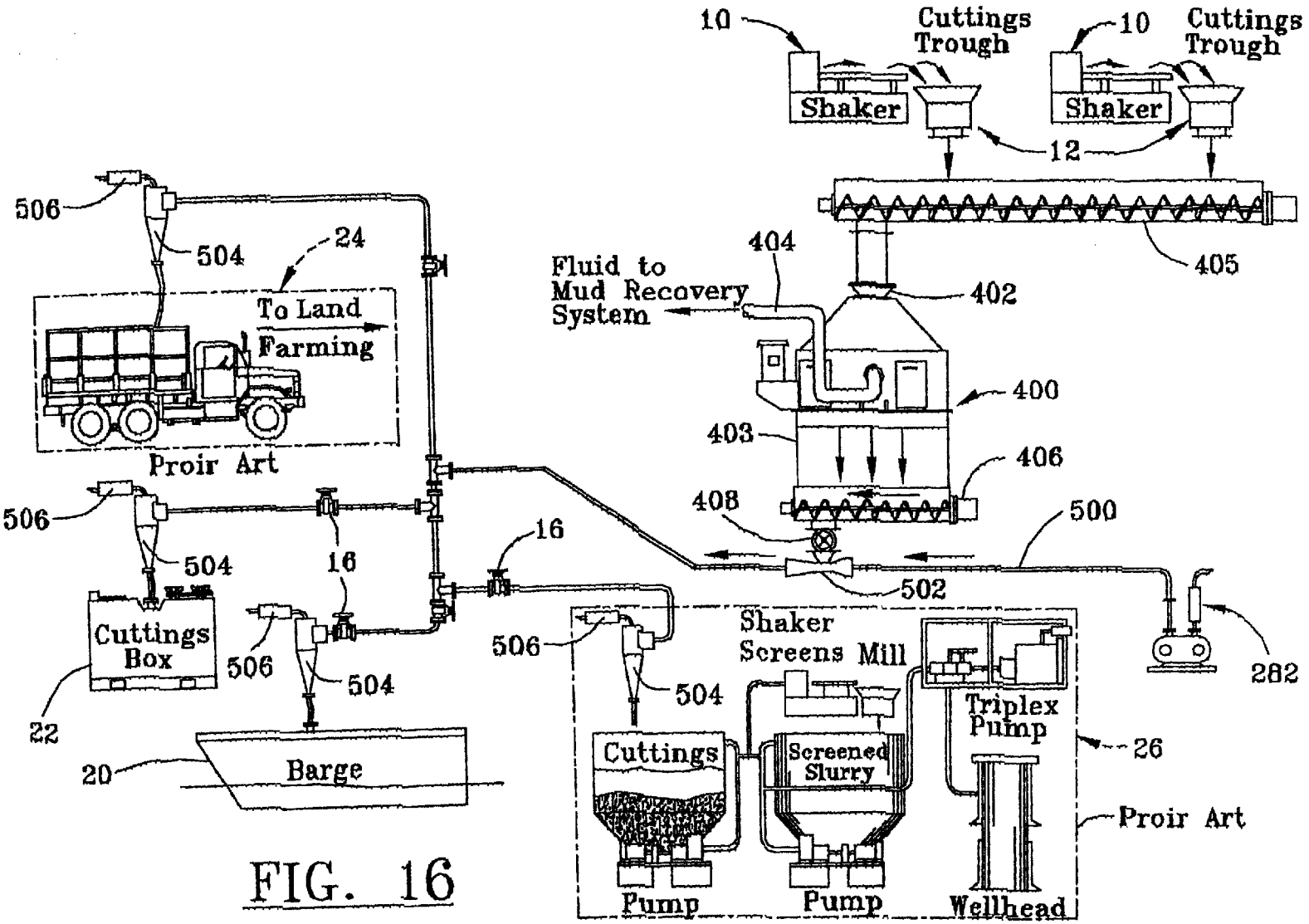
FIG. 16 is a fourth embodiment of the plumbing arrangement for the system shown in FIG. 13.

It is also anticipated that cuttings may be collected from any number of cuttings troughs 12 and conveyed by a screw conveyer 405 to the inlet of the centrifugal dryer unit 400 as seen in FIG. 16.

Figure 15:
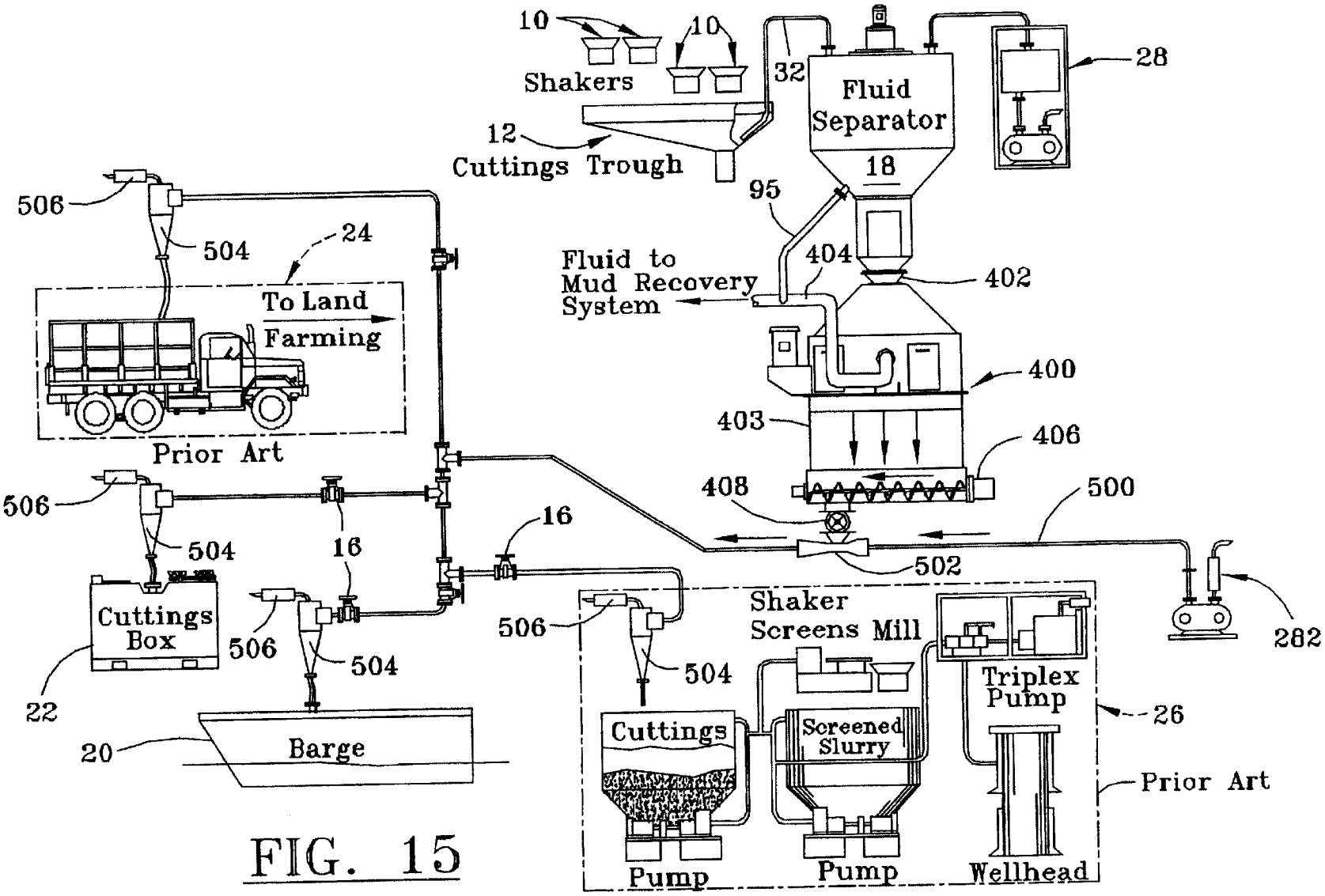
FIG. 15 is a third embodiment of the plumbing arrangement for the system shown in FIG. 13.

In either case the systems shown in FIGS. 15 and 16 reduce cuttings bulk and transport weight and further recover expensive drilling fluids.

The cuttings handling systems proposed herein offers remarkably higher levels of safety due to the reduced number of handling operations such as interventions by operatives to hook up containers to the crane, transfers of containers around the shaker station, etc. Furthermore, the sealed vacuum pressure vessel and associated network of vacuum conduits provides for delivery of cuttings to a container, re-injection equipment or transport for shipping to a remote disposal site, thereby preventing the possibility of constipation due to high production of drill cuttings at any given time.

The full significance of the capabilities of the system proposed here, and variants thereof will be apparent to those appropriately skilled in this art and who will recognize that the scope of the invention is not limited to the illustrative embodiment specifically described above.

What is claimed is:

1. A system for moving heavy drill cuttings from a drill site shaker screen and cuttings trough to various points on and around a drill site comprising:

a) a first cuttings transfer means having containment means for receiving said drill cuttings for extracting and receiving drill cuttings entrained in a fluid slurry from said cuttings trough;

b) a fluid separator apparatus adapted to said first transfer means for recovering virtually all residual drilling fluids and mud from said cuttings while drying said drill cuttings to a moisture content of between 2 and 5% by weight;

c) a collecting bin for holding dried drill cuttings discharged from said fluid separator means;

d) a second cuttings transfer means adapted to said collecting bin for discharging said dried drill cuttings in an extruded manner; and e) a conduit network connected to said second transfer means said conduit network comprising a plurality of valves for selectively directing said dried drill cuttings being extruded into said network by said second transfer means to a plurality of disposal discharge ports selectable by operating said valves.

2. The system according to claim 1 wherein said first transfer means is a gravity feed chute connected to discharge port of said cuttings trough and inlet to said fluid separator.

3. The system according to claim 1 wherein said first transfer means comprises a vacuum means or collecting said drill cuttings from said cuttings trough and discharging said cuttings slurry into said fluid separator means.

4. The system according to claim 3 wherein said vacuum means further comprises a means for force feeding said drill cuttings from said vacuum means into said fluid separator.

5. The system according to claim 3 wherein said vacuum means further comprises a means for recovering fluids from said slurry for reuse by compression of said drill cuttings.

6. The system according to claim 1 wherein said transfer means is a pneumatic system for transferring said drill cuttings, adapted to said collecting bin and said conduit network.

7. The system according to claim 1 wherein said fluid separator means is a centrifugal dryer.

8. The system according to claim 7 wherein said centrifugal dryer contains a means for recovering fluids from said slurry for reuse as a result of spin drying.

9. The system according to claim 8 wherein said centrifugal dryer further comprises a receiving and holding bin attached thereto for collecting dried drill cuttings discharged from said centrifugal dryer.

10. The system according to claim 9 wherein said receiving and holding bin further comprises a means for forcibly discharging and metering said dry drill cuttings from said holding bin into said conduit network.

11. The system according to claim 10 wherein said conduit net work is positively charged with pressure and further comprises a venture' pump to assist in the discharge of said dry drill cuttings from said holding bin into said conduit network.

12. The system according to claim 10 wherein said dry drill cuttings are drawn through said conduit network by vacuum.

13. The system according to claim 10 wherein each of said disposal discharge ports is fitted with a cyclone separator operable pneumatically.

14. The system according to claim 1 wherein at least one of said disposal discharge ports is connected to a cutting injection system.

15. The system according to claim 1 wherein at least one of said disposal discharge ports comprises a cyclone separator.

16. A drill cuttings distribution system comprising:

a) a solids pump having a receiving vessel attached to an inlet of said solids pump;

b) a vacuum pump attached to said receiving vessel;

c) a suction line connected to said receiving vessel for remotely collecting and conducting drill cuttings into said vessel;

d) a centrifugal dryer with fluid separation means and having means for receiving said drill cuttings from said solids pump;

e) a means for recovering fluids separated and discharged from said drill cuttings;

f) a means for receiving and storing dry cuttings discharged from said centrifugal dryer;

g) a means for discharging said dry cuttings from said means for receiving and storing dry cuttings and g) a means for selectively conducting said dry cuttings pneumatically from said means for discharging dry cuttings, to remote disposal discharge ports.

17. The drill cuttings distribution system according to claim 16 wherein said means for selectively conducting is a system of pipes having a plurality of valves therein for routing said dry drill cuttings to various discharge ports.

18. The drill cuttings distribution system according to claim 17 wherein said means for discharging said dry cuttings from said means for receiving and storing dry cuttings comprises:

a. a conveying means having a discharge port connected to said means for selectively conducting said drill cuttings;

b. a cyclone separator having an inlet and outlet said inlet connected to said means for selectively conducting said drill cuttings said cyclone separator located at each of said remote discharge ports said outlet of each said cyclone separator connected to a vacuum pump; and c. a means for collecting and transporting said dry drill cuttings discharged from each said cyclone separator.

19. The drill cuttings distribution system according to claim 17 wherein said system further comprises:

a) a means for pressurizing said system of pipes;

b) a feed means for collecting and metering said drill cuttings discharged from said centrifugal dryer into said pipes said feed means further comprising a venturi locate inline with said pipes;

c) a cyclone separator having an inlet and outlet said inlet connected to said means for conducting said drill cuttings said cyclone separator located at each of said remote discharge ports said outlet of each said cyclone separator connected to a vacuum pump;

d) an exhaust filter attached to said outlet of each said cyclone separator; and e) a means for collecting and transporting said drill cuttings discharged from each said cyclone separator.

20. A method for moving heavy drill cuttings from point to point about a drill site comprising the step of providing a means for collecting and transferring heavy drill cuttings entrained in a fluid slurry, providing preliminary fluid separation and recovery means, providing secondary fluid separation and recovery means and discharging said heavy drill cuttings in a dry form into a conduit transfer system for discharge at various points on and around a drill site.

21. The method according to claim 20 further including the step of employing a vacuum system as said means for collecting and transferring said heavy drill cuttings to said secondary drying means.

22. The method according to claim 21 wherein said method further comprises the steps of:

a) compressing said heavy drill cuttings and recovering fluids from said drill cuttings for reuse;

b) centrifugally drying and recovering remaining fluids from said drill cuttings discharged from said preliminary fluid separation and recovery means; and c) discharging defluidized dry cuttings from said secondary drying means through a conduit system selectively into a plurality of transport means.

23. The method according to claim 20 wherein said method further includes the steps of:

a) providing a separator means for receiving and defluidizing said cuttings;

b) defluidizing said cuttings within said separator;

c) recovering said fluid for reuse; and d) discharging defluidized cuttings into a re-injection cuttings processing system.

24. The method according to claim 23 wherein said separator means for defluidizing said cuttings slurry further comprises the steps of:

a) receiving said cuttings slurry containing fluids and solids into an upper chamber by reducing pressure below atmosphere in said chamber;

b) conveying said cuttings slurry through a central strainer towards a blocked pressure adjustable discharge port;

c) compressing said cuttings slurry within said strainer;

d) expressing said fluids and solids less than 20 micron through said strainer;

e) collecting and recovering said fluids;

f) forcing said blocked discharge port to open against a preset pressure; and g) discharging defluidized cuttings.

25. The method according to claim 24 further comprising the step of pumping the recovered fluids and solids under 20 microns from said separator means to a remote location.

* * * * *